US005306896A

United States Patent [19]

Glater et al.

[11] Patent Number: 5,306,896

[45] Date of Patent: Apr. 26, 1994

[54] METHOD AND APPARATUS FOR OPEN DIGESTION OF SPECIMENS UTILIZING INCLINED CONTAINER SUPPORT MEANS WITH ELECTRIC HEATER

[75] Inventors: Michael Glater, Brooklyn; Yury Zlobinsky, Massapequa, both of N.Y.

[73] Assignee: Savant Instruments, Inc., Farmingdale, N.Y.

[21] Appl. No.: 902,062

[22] Filed: Jun. 22, 1992

[51] Int. Cl.[5] ..... H05B 3/02

[52] U.S. Cl. ..... 219/521; 219/535; 219/433; 219/385

[58] Field of Search ..... 219/521, 535, 385, 433; 422/101; 202/160, 206

[56] References Cited

U.S. PATENT DOCUMENTS

| | | | |
|---|---|---|---|
| 2,031,019 | 2/1936 | Walker et al. | 219/385 |
| 2,220,043 | 10/1940 | Humphrey et al. | 219/385 |
| 3,109,084 | 10/1963 | Walsh | 219/521 |
| 3,737,627 | 6/1973 | Willard et al. | 219/521 |
| 4,840,771 | 6/1989 | Williamson et al. | 219/433 |
| 5,229,580 | 7/1993 | Chioniere | 219/521 |

*Primary Examiner*—Bruce A. Reynolds
*Assistant Examiner*—John A. Jeffrey
*Attorney, Agent, or Firm*—George J. Brandt, Jr.

[57] ABSTRACT

Acid digestion of liquid specimens which are to be subsequently analyzed by spectroscopy to identify recoverable or dissolved metals is effected in an open digestion operation in apparatus which includes inclined, vertically spaced saddles on which specimen containing glass jars are supported in corresponding inclined orientation so that a surface of the specimens in the jars is overlaid by the wall of the jar and the jar opening is remote from the specimen, this arrangement allowing that the vessel wall facing the specimen surface, during digestion, will serve as a condensing surface for specimen vapors evolved incident digestion. The saddles are carried on an upright frame rotatably mounted on a base so that the upright frame can be moved between jar loading/unloading and digestion operation positions, jar loading/unloading on the upright frame involving inserting/removing the jars on the saddles while the frame is in a position where it is conveniently accessed by an operator for this purpose, but the upright frame thereafter being rotated to a digestion position thereof that reduces greatly, to the safety advantage of an operator, any chance of splatter of specimen during the digestion striking the operator. The saddles each embody a heater therein.

16 Claims, 4 Drawing Sheets

METHOD AND APPARATUS FOR OPEN DIGESTION OF SPECIMENS UTILIZING INCLINED CONTAINER SUPPORT MEANS WITH ELECTRIC HEATER

BACKGROUND OF THE INVENTION

The present invention relates to open digestion of liquid specimens which are to be thereafter analyzed by spectroscopy to determine metals content therein and, refers more particularly, to method and apparatus by which this open digestion is practiced.

Acid digestion is used, for example, to prepare surface water and ground water samples or specimens for analysis by spectroscopy to ascertain presence of various metals. This is done to effectively deal with recovery or safe disposal of the metals in the water. Metals of interest are numerous, cobalt, iron and lead, to name but a few, being examples.

The acid digestion generally will be carried out by placing the sample in a glass dish and heating the sample therein on a hot plate. A reflex cover is placed over the dish to condense vapors evolving in the digestion process and to prevent splatter of reagent acid added to the specimen as part of the digestion protocol.

In the heating of the specimen to reduce it from an initial volume of say 105 ml (100 ml water and 5 ml reagent) to a desired volume of, e.g., 5 or 10 or 25 ml, same is boiled slowly and the evaporation rate, due to the dish presenting a constant bottom surface heat transfer area, will be substantially constant. Due to constant evaporation rate, it becomes difficult to observe accurately reduction of specimen volume in the dish to a particular specimen level associated with a desired final specimen volume. As a result, specimens at volumes near that desired frequently pass to dryness before an operator realizes such is occurring, and the whole purpose of the protocol is vitiated.

Difficulty in marking a level at which a desired reduced volume is present can be appreciated by noting that in a large cross sectional area dish or beaker, a ⅛th inch depth of specimen may represent that volume. Noting a level change to 3/32nd or 1/16th inch can be hardly discernible but yet specimen volume of 25% to 50% below that desired can have taken place.

Utilization of hot plate heating of plural specimens in upright beakers at the same time has the additional disadvantages of possible misidentification of a given specimen with another on completion of heating, or chance of an operator accidentally knocking over a standing beaker.

It is desirable, therefore, that improved means and manner be provided by which liquid specimens can be treated in an open digestion/concentration operation without hazard that the specimens inadvertently will be dried, spilled or otherwise contaminated by events attending heretofore hot plate practiced protocols.

OBJECTS AND SUMMARY OF THE INVENTION

Accordingly, it is an object of the invention to provide an open digestion method and apparatus which overcomes the drawbacks of the prior art.

It is a further object of the invention to provide method and apparatus for open digestion of liquid specimens with which an initial volume of a given specimen can be evaporated down to a desired second liquid specimen volume accurately and with little hazard that the evaporation operation will run to partial or complete specimen drying.

It is a still further object of the invention to provide a method and apparatus with which plural numbers of the same type of specimen as well as numbers of other types of specimens can be subjected to open digestion treatment at the same time.

Another object of the invention is to provide method and apparatus for open digestion of liquid specimens which provide safe and simple utilization of same.

Yet another object is to provide method and apparatus for open digestion purpose that reduces labor need, minimizes chance for operator error, cuts down possibility of specimen contamination one to another, sample loss in the handling and which involves use of but minimum laboratory space in carrying out the digestion protocol.

Briefly stated, there is provided that acid digestion of liquid specimens which are to be subsequently analyzed by spectroscopy to identify recoverable or dissolved metals is effected in an open digestion operation in apparatus which includes inclined, vertically spaced saddles on which specimen containing glass jars are supported in corresponding inclined orientations. A surface of the specimens in the jars is overlaid by the wall of the jar and the jar opening is remote from the specimen, this arrangement allowing that the vessel wall facing the specimen surface during digestion, will serve as a condensing surface for specimen vapors evolved incident digestion. The saddles are carried on an upright frame rotatably mounted on a base so that the upright frame can be moved between jar loading/unloading and digestion operation positions. Jar loading on the upright frame involves inserting the jars on the saddles while the frame is in a loading position where same conveniently can be accessed by an operator for this purpose. Accessing a digested sample for unloading is equally easy and involves frame rotation from the digestion to load/unload position for that purpose. The loaded upright frame in digestion operation position thereof reduces greatly, to the safety advantage of an operator working at or near the apparatus, any danger of splatter of specimen during the digestion striking the operator since in that position, the jar opening faces rearwardly of where an operator would stand. The saddles each embody a heater therein.

In accordance with these and other objects of the invention, there is provided apparatus for use in the digestion/concentration treatment of a liquid specimen, which treatment includes subjecting the specimen to a heating operation while contained in a vessel comprising an open top elongated encircling wall body, said body having a generally uniform cross section of predetermined area which defines a liquid surface expanse of corresponding area for an initial volume of liquid specimen contained in the vessel when the vessel is in upright position that includes an upright frame. Means are on the frame for supporting at least one liquid specimen-containing vessel thereon. A heater is carried on the upright frame and is positioned to direct a heat output therefrom against a defined heat transfer area on the vessel body wall. This heat transfer area partly encircles the body wall and extends longitudinally therealong from a first location proximal but spaced from a vessel bottom to a second wall location remote from said bottom. The support means supports the vessel in a position inclined relative to the frame so that the liquid surface expanse of an initial specimen volume is greater than the said corresponding area and the body wall overlays the liquid surface. Heat output from the heater transfers through the heat transfer area to heat liquid specimen and reduces the level between the first and second locations. This reduction diminishes the heat transfer area in contact with the liquid and correspondingly diminishes evaporation rate so that a time for the liquid surface level to reduce to the first location is prolonged as the level approaches the first location.

According to a feature of the invention, there is further provided a method for the digestion/concentration treatment of a liquid specimen which includes heating the specimen while it is contained in a vessel comprising an open top elongated encircling wall body, said body having a generally uniform cross section of predetermined area which defines a liquid surface expanse of corresponding area for an initial volume of the liquid specimen contained in the vessel when the vessel is in upright position, the method involving supporting the vessel at an inclined position thereof so that the liquid surface expanse of the initial specimen volume is greater than the said corresponding area and the body wall overlays the liquid surface. Further there is defined a heat transfer area on the vessel wall in a course partly encircling thereof and extending a distance longitudinally along the said wall from a first wall location proximal but spaced from a vessel bottom to a second wall location remote from said bottom. A heat output from a heater is directed against the vessel heat transfer area whereby the heat output can transfer through the vessel wall and heat the liquid specimen to cause evaporation thereof at an evaporation rate which diminishes as the level approaches said first wall location thereby prolonging a time for the liquid to reduce to said first wall location.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
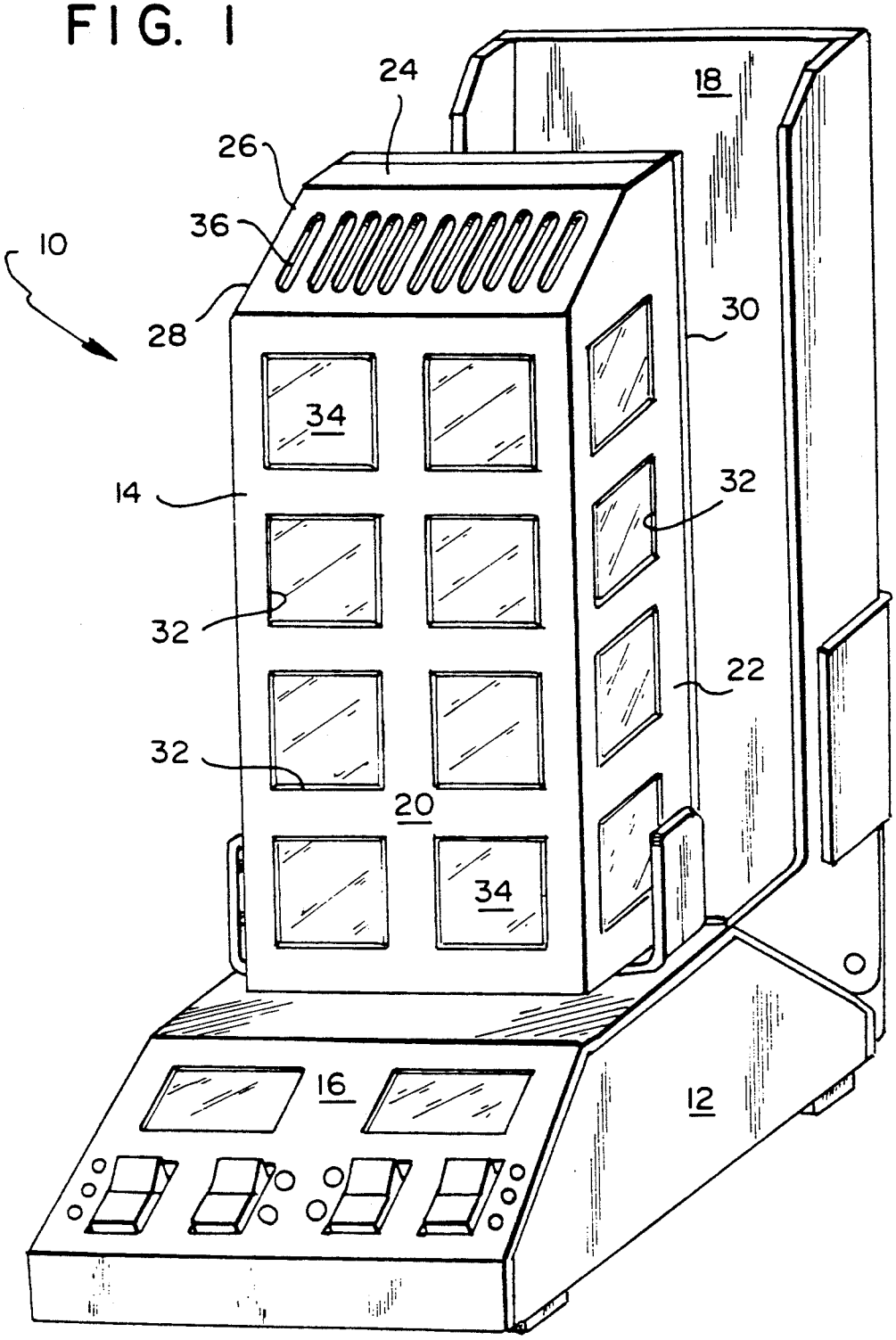
FIG. 1 is a perspective view of an open type digester/concentrator apparatus constructed in accordance with the principles of the present invention.

Referring now to FIG. 1, there is shown digester/concentrator apparatus 10 which includes a base 12 on which is rotatably mounted an upright frame 14, the front side of the base being fitted with a control panel 16, and there being an upright, channel shaped anti-splash shield 18 mounted at the base rear side, the shield 18 being rearwardly spaced from the upright frame so the frame has clearance from the shield to rotate as described later and for the purpose to be given.

Upright frame 14 is comprised of a number of panels 20–30 provided as side, top, front and rear members arranged cooperative to define an enclosure or housing structure, a rear vertical one of such panels comprising an enclosure rear wall 30 which additionally to being a barrier component functions to support jar saddles and other elements as will be described later.

Certain of the panels can have cutout window openings as at 32 which can be covered with glass squares 34. The enclosure also can have top vent openings as at 36. The window openings 32 can be left open and instead of plural such openings, a panel may contain one large window as at 40 in FIG. 2.

Figure 2:
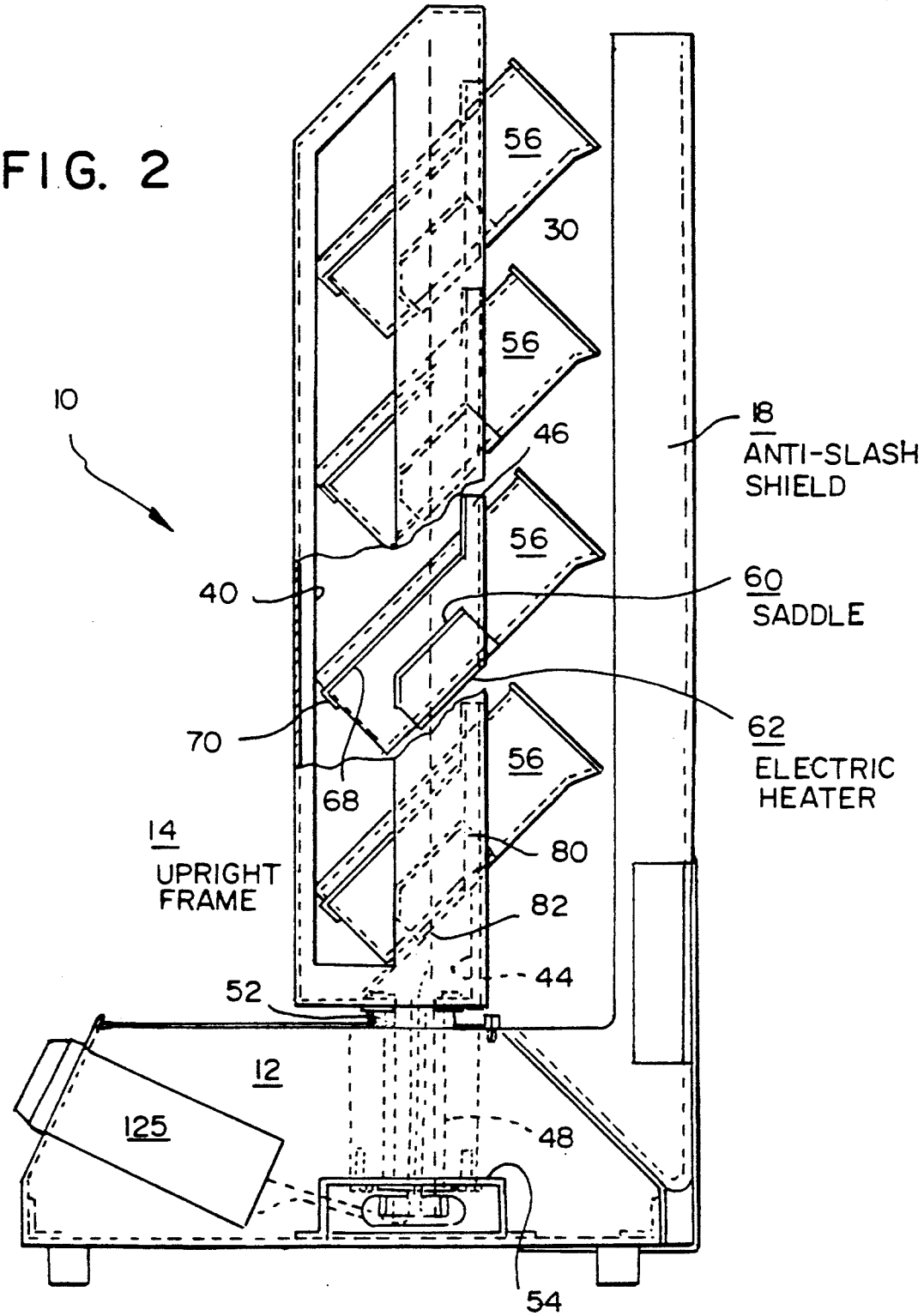
FIG. 2 is a side elevational of the apparatus shown in FIG. 1, except the upright frame thereof is modified from that shown in FIG. 1, the upright frame being depicted in the digestion position.

The panels 20–30 can be secured to each other and to support members in the frame such as brackets 44 seen in FIG. 2.

The upright frame 14 is as mentioned above, rotatable on base 12. This is provided by means of vertical tubular shaft length 48 carried at bottom of the upright frame being received in bore support elements 52, 54 on the base 12. Rotatable movement of the upright frame will be user or operator initiated and as will be explained later.

The upright frame 14 provides receiving structure for supportingly holding one or plural glass specimen holding vessels or jars 56 as seen best in FIG. 2. The upright frame can be designed to hold, for example, two vertical side-by-side arrayed rows of jars. The specimens being digested in one row could be a given type, and the specimens in the other row, a different type, this diversity capability of being able to digest different types at the same time, being of great advantage in a laboratory in regard to productivity.

Figure 4:
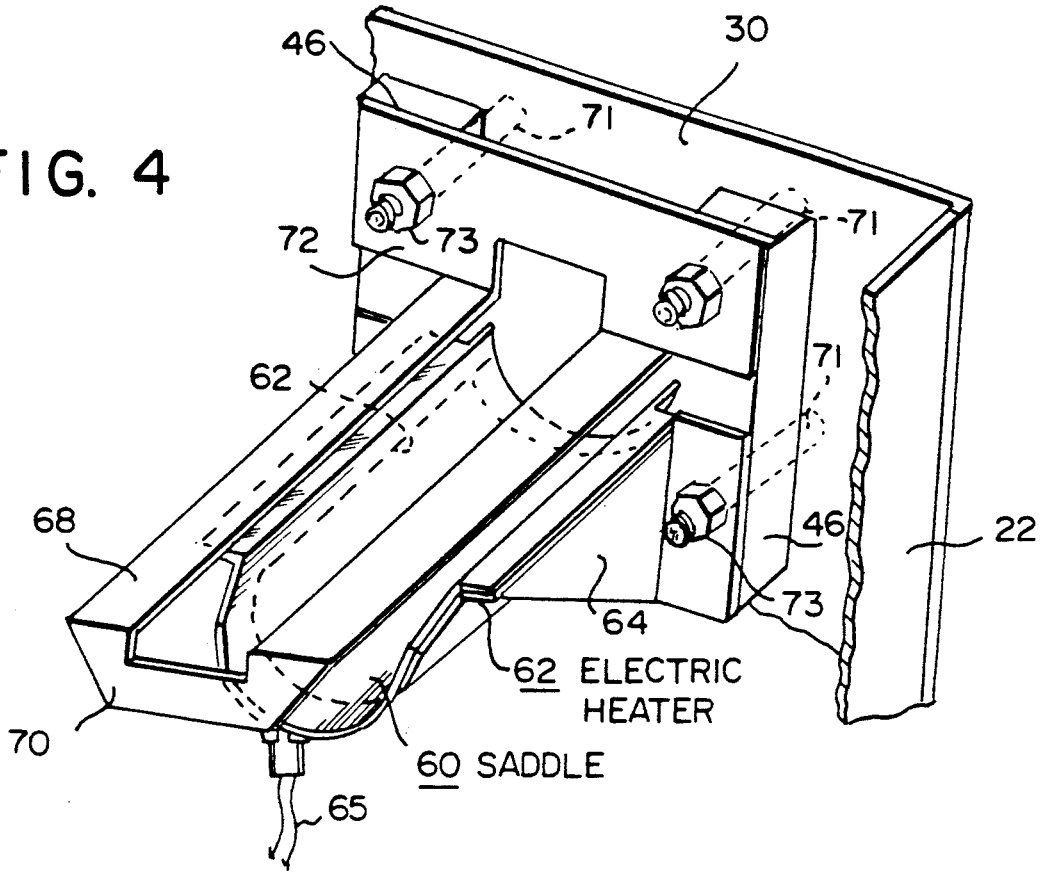
FIG. 4 is a perspective view of one of the saddles carried on the upright frame on which specimen containing vessels such as jars are supported, the vessel retainer associated with each saddle also being shown, the saddle and retainer being fixed to a vertical rear wall member of the upright frame, a vessel not being shown supported on the saddle.
Figure 5:
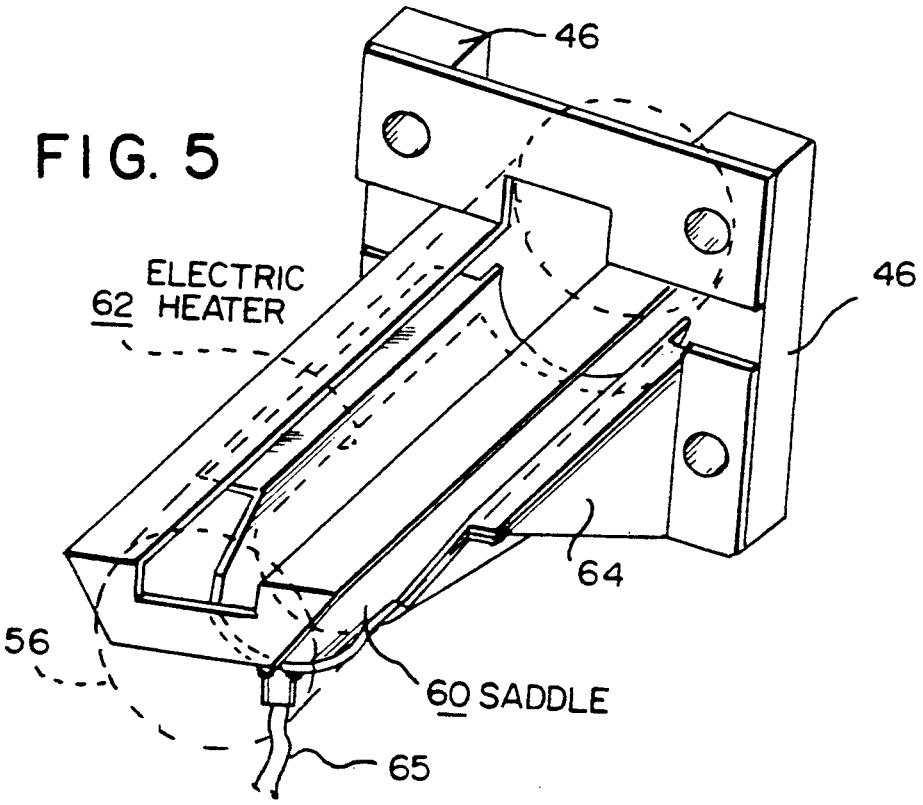
FIG. 5 is the same as FIG. 4 except a glass specimen jar is shown received on the saddle.

Referring to FIGS. 2, 4 and 5, the upright frame 14 carries saddles 60 on which the jars 56 are received. The saddles 60 are shaped members of thin good thermally conductive material such as PTFE coated aluminum. As a general consideration and due to the corrosive nature of the digestion operation, the frame and parts internally thereof will be PTFE or other anti-corrosive material coated components.

The saddles are configured to correspond to external wall portions of the jars. The jars 56 can be, for example, cylindrical, and accordingly the saddles would be shaped conformably to a cylinder external surface.

Each saddle 60 in addition to supporting a jar 56, functions to transfer heat from a heat output source through jar wall and into a liquid specimen contained in the jar. Various means of producing required heat output are possible.

Particularly advantageous is to use an electric plate heater 62 as the heat source. The heater can be silicone rubber covered and vulcanized to the underside of the saddle. Each plate heater is configured to closely contactingly fit its associated saddle 60. The plan outline of the heater 62 is seen in dashed lines in FIGS. 4 and 5 from which it is noted the expanse of the heater is slightly less than that of the saddle 60. Heater 62 it will be seen can be connected to power by cable 65.

The expanse of the heater and this expanse as projected through the saddle, defines a heat transfer area on the jar which partly encircles the wall of the jar, and which extends longitudinally of the jar from a first location proximal a bottom thereof to a second location remote from the jar bottom. This can best appreciated with reference to FIGS. 2 and 5.

As seen in FIG. 4, each saddle is fixed to rear wall 30 by means of studs 71 carried on the rear wall, the studs passing forwardly through bracket-shaped extensions 64 of the saddle and securement thereof on the studs effected with nuts 73. Intervening rear wall 30 and the saddle mounting are vertical heat insulative spacer strip elements 46.

Each saddle 60 also has associated therewith, a retainer blade 68 of flat, shaped thin metal, the forward end of the blade being turned down as at 70 to engage forwardly of the bottom of a jar to hold it from sliding off the saddle due to gravity since the saddles are inclined relative to the upright frame, e.g., at an angle of forty-five degrees therewith and with a horizontal datum. The rear end of the retainer blade 68 is joined to a mounting strip 72 and this in turn is secured to rear wall 30 with a stud/nut arrangement. The retainer blade will be PTFE coated in like manner as the saddle.

When a jar 56 is in upright position, the surface of the liquid specimen confined therein corresponds in area to the cross section area of the jar. When that jar is inclined in received position on a saddle, the liquid specimen surface area is much greater but this surface is overlaid by the jar wall so that the wall serves as a vapor condensing surface. Further, the open top of the jar is offset from an initial liquid specimen volume location in the jar so that any "bumping" of liquid or reagent during digestion will strike the jar wall above the liquid and not be lost as could occur where the open top is directly above the liquid.

When a liquid specimen of 100 ml plus 5 ml reagent is contained as an initial volume in a jar 56 and the jar is inclined, the level of that volume will be at 80, FIG. 2. In that condition, substantially all the liquid specimen will be in contact with the defined heat transfer area on the jar. When the heater is turned on, heat will transfer into the liquid specimen and in time evaporation will ensue. Evaporation will be accompanied by change of the level height in the jar and as the level drops, heat transfer will also drop and correspondingly, the evaporation rate reduces prolonging the time it takes for the level to reduce as it approaches level 82. The prolongation allows an operator to more readily observe the desired reduction level presence, and thus, likelihood of evaporating to dryness is minimized.

The variable character or volume sensitive nature of the evaporation rate provided with the invention is most significant and is illustrated by considering that heat will pass into the jar only normal to the wall and thence into liquid behind the wall. If there is no liquid behind the wall at a location, heat output present at the location has nowhere to go since heat transfer axially in the vessel wall can only be negligible. Thus as the level drops, the heat input rate to the specimen drops and, in turn, evaporation slows down.

An observer watching arrival of the liquid level at location 82, thus has ample time to see this take place and no gross further evaporation will occur as the level is now at a point where no liquid is immediate any part of the vessel or jar wall structure that is in the defined heat transfer area. With the liquid level at 82, the volume of the liquid in the jar will correspond to a desired one, namely, 25 ml.

Depending on the inclination at which a jar is positioned as well as the defining of the heat transfer area, and locating of the first and second locations of that area, initial volumes can be reduced to what will be reduced liquid specimen volumes that are other than 25 ml.

Figure 3:
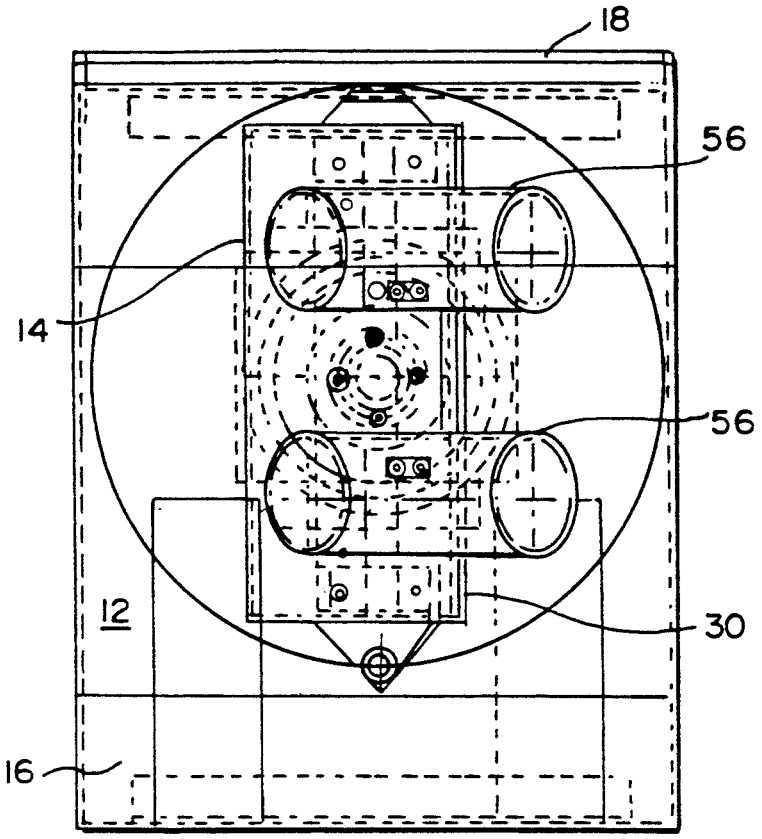
FIG. 3 is a top plan view of the FIGS. 1 and 2 apparatus but with the upright frame being positioned in the vessel loading/unloading position thereof.

The upright frame 14 normally will be detent held in a digestion positioning thereof as depicted in FIG. 2. In that position the open tops of the jars face the anti splash shield and are directed away from where an operator might be present at a work bench etc. The upright frame can, however, be rotated from detented position about 90 degrees in either right or left direction. This will be done to load/unload jars from the frame, add reagent to the specimen, or to make visual inspection of the specimens. One such positioning is seen in FIG. 3. In that position access to the jars is greatly simplified.

Figure 6:
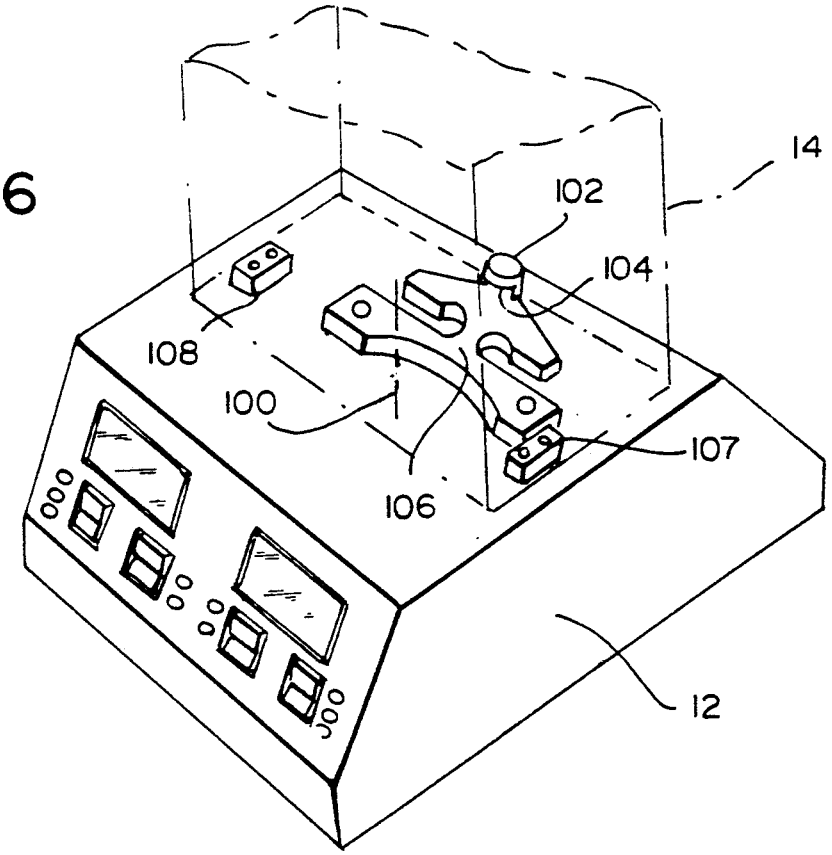
FIG. 6 is a fragmentary perspective view of the base portion with the upright frame in phantom, depicting a detent arrangement normally detent holding the upright frame in digestion operation positioning thereof.

Referring to FIG. 6, upright frame 14 is depicted in phantom. It will rotate about vertical axis 100. The base 102 carries a fixed pin 102 that in frame digestion operation position is engaged by the arcuate part 104 of a cam body 106 carried at the underside of the frame. The body 106 is of spring-like character so that if rotation force of moderate magnitude be applied to the upright frame, the cam will yield and the detent groove 104 will move away from the pin 102 and thereby allow travel of the frame to a load/unload position. Stops 107, 108 carried at the bottom of the frame will abut the pin 102 to stop frame rotation.

In connection with heaters 60, same will be designed with regard to particular digestion protocols. For many such though, heaters with a capacity up to 150 degrees C. can be used and these controlled to provide heating any where in a temperature range 30 degrees to 150 degrees C. Further, heating rates can be varied, e.g., to be increased at a rate of 10 degrees C./min.

The heaters can be individual controlled or they can be series connected for each vertical row array of such. As seen in FIG. 2, a controller 125 can be used to control heater operation such as continuous control of specimen temperature, and panel 16 will mount switches, digital display devices etc required for control and monitoring of digestion conditions. The operation can be microprocessor controlled.

Jars 56 in advantageous form can be PYREX and have a top flange and pouring spout.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Apparatus for use in the digestion/concentration treatment of a liquid specimen, which treatment includes subjecting the specimen to a heating operation while contained in a vessel comprising an open top elongated encircling wall body, said body having a generally uniform cross section of predetermined area which defines a liquid surface expanse of corresponding area for an initial volume of liquid specimen contained in the vessel when the vessel is in upright position, the apparatus comprising an upright frame, means on the frame for supporting at least one liquid specimen-containing vessel thereon, and a heater carried on the upright frame and positioned to direct a heat output therefrom against a defined heat transfer area on the vessel body wall which heat transfer area partly encircles the body wall and extends longitudinally therealong from a first location proximal but spaced from a vessel bottom to a second wall location remote from said bottom, the support means supporting the vessel in a position inclined at an angle of about 45 degrees relative to a horizontal datum so that the liquid surface expanse of an initial specimen volume is greater than the said corresponding area and the body wall overlays the liquid surface and in which position substantially all the initial specimen volume will be in contact with the defined heat transfer area, heat output from the heater transferring through the heat transfer area to heat the liquid specimen and reducing the level thereof between said first and second locations, reduction of said level diminishing the heat transfer area in contact with the liquid and correspondingly diminishing evaporation rate so that a time for the liquid surface level to reduce to said first location is prolonged as the level approaches said first location.

2. Apparatus in accordance with claim 1 further comprising means for controlling the heat output of the heater to effect a heat input to the specimen at a predetermined rate.

3. Apparatus in accordance with claim 1 in which the vessel supporting means includes a saddle carried by the upright frame, the saddle having a configuration conformable with at least the configuration of the vessel on which the heat transfer area is defined.

4. Apparatus in accordance with claim 3 in which the saddle is comprised of a good thermally conductive material, and the heater underlies the saddle.

5. Apparatus in accordance with claim 4 in which the heater includes a heat output plate, the heat output plate having a configuration conforming with that of an underside of the saddle whereby the heat output plate can contact the saddle underside in good thermal conductive contact therewith.

6. Apparatus in accordance with claim 1 in which the vessel supporting means includes a retainer engageable with the vessel for holding said vessel in inclined position against an effect of gravity.

7. Apparatus in accordance with claim 1 in which the upright frame is mounted rotatably on a base, the upright frame being rotatable about a vertical axis between a vessel mounting position at which a vessel can be mounted on or removed from the saddle to a digestion operation position in which the open top of the vessel faces a splash protection shield carried on the base and extending upwardly relatively of the upright frame spaced therefrom.

8. Apparatus in accordance with claim 7 in which the base and upright frame carry cooperating detent structures for normally detent holding of the upright frame in digestion operation position thereof.

9. Apparatus in accordance with claim in which the vessel supporting means includes a plurality of saddles for supporting a corresponding plurality of vessels, there being a corresponding plurality of heaters associated one with each of said saddles.

10. In a method for the digestion/concentration treatment of a liquid specimen which includes heating the specimen while it is contained in a vessel comprising an open top elongated encircling wall body, said body having a generally uniform cross section of predetermined area which defines a liquid surface expanse of corresponding area for an initial volume of the liquid specimen contained in the vessel when the vessel is in upright position, the steps comprising supporting the vessel at an inclined position at an angle of about 45 degrees to a horizontal datum so that the liquid surface expanse of the initial specimen volume is greater than the said corresponding area and the body wall overlays the liquid surface, defining a heat transfer area on the vessel wall in a course partly encircling thereof and extending a distance longitudinally along the said wall from a first wall location proximal but spaced from a vessel bottom to a second wall location remote from said bottom so that substantially all the initial specimen volume will be in contact with the defined heat transfer area, and directing a heat output from a heater against the vessel heat transfer area whereby the heat output can transfer through the vessel wall and heat the liquid specimen to cause evaporation thereof at an evaporation rate which diminishes as the level approaches said first wall location thereby prolonging a time for the liquid to reduce to said first wall location.

11. The method of claim 10 in which the heater includes a heat output surface, and the output surface is maintained in good thermally conductive contact with the vessel wall at the heat transfer area thereon.

12. The methods of claim 10 in which the initial specimen volume is about 100 milliliters.

13. The method of claim 12 in which the reduced specimen volume is about 25 milliliters.

14. The method of claim 10 in which the specimen is heated during digestion/concentration to a temperature which is one in a range between about 30 degrees C. and 150 degrees C.

15. The method of claim 14 in which the specimen is heated to the said one range temperature at a rate of about 10 degrees C./min.

16. The method of claim 10 including controlling the temperature of the specimen continuously during the heating thereof.

* * * * *